US007364360B2

(12) United States Patent
Urman et al.

(10) Patent No.: US 7,364,360 B2
(45) Date of Patent: Apr. 29, 2008

(54) PACKAGE FOR HORIZONTAL TRANSPORT

(76) Inventors: Craig A. Urman, 1 Alumbre, Rancho Santa Margarita, CA (US) 92688; Martin Reall, 14771 Livingston Rd., Tustin, CA (US) 92780

( * ) Notice: Subject to any disclaimer, the term of this patent is extended or adjusted under 35 U.S.C. 154(b) by 0 days.

(21) Appl. No.: 10/681,472

(22) Filed: Oct. 8, 2003

(65) Prior Publication Data

US 2004/0066982 A1 Apr. 8, 2004

Related U.S. Application Data

(63) Continuation of application No. 10/043,054, filed on Jan. 8, 2002, now Pat. No. 6,655,526.

(60) Provisional application No. 60/260,197, filed on Jan. 8, 2001.

(51) Int. Cl.
*B65D 33/06* (2006.01)
*B65D 33/01* (2006.01)
*B65D 33/16* (2006.01)
*B65D 33/20* (2006.01)

(52) U.S. Cl. ..... 383/6; 383/66; 383/86; 383/103; 383/120

(58) Field of Classification Search ..... 383/12, 383/25, 84, 86, 100, 103, 15–17, 38, 40, 383/120, 66, 6–8, 109, 20; 493/413
See application file for complete search history.

(56) References Cited

U.S. PATENT DOCUMENTS 1,257,057 A 2/1918 White
2,884,183 A * 4/1959 Frankel ..... 281/19.1
3,224,640 A * 12/1965 Schneider et al. ..... 222/107
3,558,040 A * 1/1971 Krueger ..... 229/302
3,744,383 A 7/1973 Finch
3,834,528 A * 9/1974 Pickford et al. ..... 206/526
3,979,051 A * 9/1976 Close ..... 229/72
3,987,959 A * 10/1976 Deards et al. ..... 383/10
4,061,241 A 12/1977 Retelny
4,241,863 A 12/1980 Faller
4,555,804 A * 11/1985 Canning et al. ..... 383/25
4,578,814 A * 3/1986 Skamser ..... 383/99
4,802,233 A * 1/1989 Skamser ..... 383/15
4,913,693 A 4/1990 Ball
5,351,880 A 10/1994 Goudreau
D372,858 S * 8/1996 Sunley ..... D8/499
5,573,489 A 11/1996 Letendre
5,709,641 A * 1/1998 Vaquero ..... 493/243
5,741,077 A * 4/1998 Sasaki et al. ..... 383/10
5,882,118 A 3/1999 Daniels
5,950,912 A 9/1999 Economopoulos
6,012,844 A * 1/2000 Huseman et al. ..... 383/93
6,655,526 B2 * 12/2003 Urman et al. ..... 206/223

OTHER PUBLICATIONS

A Best Kitchen.com, Pizz Delivery Bags, Apr. 11, 2005.*

* cited by examiner

*Primary Examiner*—Robin A. Hylton
(74) *Attorney, Agent, or Firm*—Knobbe Martens Olson & Bear, LLP

(57) ABSTRACT

A packaging system consisting of a sealable bag with an optional exterior pocket and an integral handle fastened across the top side that allows for the horizontal storage and transport of food products and other goods.

17 Claims, 4 Drawing Sheets

PACKAGE FOR HORIZONTAL TRANSPORT

CROSS REFERENCES

U.S. Patent Documents

The present invention is the continuation of regular patent application Ser. No. 10/043,054, filed Jan. 8, 2002 now U.S. Pat. No. 6,655,526, and published as U.S. Ser. No. 2003/0127462 on Jul. 10, 2003. Said application Ser. No. 10/043,054 is itself the continuation of provisional Patent Application No. 60/260,197, filed Jan. 8, 2001.

FIELD OF THE INVENTION

The present invention relates to a transportable packaging system for products that are best carried in a horizontal position and that require spaced, insulated stacking. It is useful in the food industry as packaging for pizza, heated fast-food items, cold food items such as salads and deli products, and bakery goods. This packaging system has additional uses outside the food industry, for example as light-weight, cost-effective packaging for crushable arts and crafts, floral wreaths, toys, and any other products that are best stored and transported in a horizontal position and that need to be stacked apart without crushing. This invention is potentially reusable, and thus environmentally friendly.

BACKGROUND OF THE INVENTION

Consumer packaging has customarily taken the form of paper wraps or fold-up paper bags, which vary in thickness, density, color, size, and other features, but all of which have been produced at significant cost to the environment in terms of the raw materials required to make paper packaging. In the past several decades, plastic packaging has largely taken the place of paper wraps and bags in consumer markets.

Paper and plastic packaging for consumers have had significant drawbacks. First, these types of packaging are top-loaded and, if handles are provided, said handles are positioned in such a manner that the package must be carried vertically instead of horizontally. While goods requiring horizontal transport can be placed on the bottom of a top-loaded bag and then carried vertically, this system is not satisfactory for the following reasons. For goods that are larger in horizontal size than the bottom of the vertical packaging, the items could be crushed when the bag sides press inwards during transport. Also, the placement of such an item into a vertical bag, as well as later extrication, is difficult. Even if goods that need to be carried horizontally could fit into the bottom of a vertical bag, they would not be secure and could tip over when separated from the consumer's controlling grasp by the length of the bag. If the packaging lacks handles, then the consumer will usually find transport even more difficult, often requiring two hands or a carrying position that crushes the package and its contents between arm and body.

Second, existing paper and plastic packaging for consumers often requires some labor to prepare the packaging for use, which increases the cost of the packaging for the merchant. Boxes require folding, trays need to be pre-assembled, and bags need to be attached to dispensers.

Finally, packaging generally has no further use to the consumer after the goods are transported to the intended destination. It is simply thrown away, adding to our society's already overflowing trash problem.

There is a need for a packaging system that allows for easy horizontal transport of consumer goods, insulation during storage or transport, minimal storage space for the merchant, and minimal labor for set up and use. There is also a need for a packaging system that is pre-assembled and cost-effective to produce and that is environmentally friendly.

DESCRIPTION OF RELATED ART (INCLUDING INFORMATION DISCLOSED UNDER 37 C.F.R. 1.97 AND 37 C.F.R. 1.98)

A search of the prior art did not disclose any patents that read directly on the claims of the instant invention. However, the following U.S. patents are considered relevant:

1. The U.S. Pat. No. 5,950,912 Economopoulos Patent discloses a cardboard box for stacking two pizzas in one box.
2. The U.S. Pat. No. 5,882,118 Daniels Patent discloses a gusseted T-shirt type plastic bag and method of making such bag with a promotional strip extending along one side edge and secured at the top and bottom edges of the bag.
3. The U.S. Pat. No. 5,573,489 Letendre Patent discloses a thermoplastic bag and method for making bags with loop handles at the bag top.
4. The U.S. Pat. No. 5,351,880 Goudreau Patent also discloses a corrugated box for containing two or more stacked food products.
5. The U.S. Pat. No. 4,913,693 Ball Patent discloses a method of manufacturing a gusseted bag that has an integral handle for carrying on the bag on its side.
6. The U.S. Pat. No. 4,241,863 Faller Patent discloses a paperboard container with two open-top trays hinged together, each covered by a film to secure the food within. The entire container may be placed in a cover sleeve.
7. The U.S. Pat. No. 4,061,241 Retelny Patent discloses a food plate packaging with a bottom plate that fits into a ribbed top cover that can support other similar plates when stacked on each other.
8. The U.S. Pat. No. 3,744,383 Finch Patent discloses an apparatus and method for manufacturing plastic bags with a promotional band in a single stage process.
9. The U.S. Pat. No. 1,257,057 White Patent discloses a pie container with a cover and a loop or yoke and clip for attaching and holding a fork to the container.

For background purposes and as indicative of the art to which the invention is related reference may be made to the other cited patents.

BRIEF SUMMARY OF THE INVENTION

The present invention consists of a transportable packaging system by which food and other products can be stored and transported in a horizontal position. The packaging system is comprised of a sealable bag with a front-loading opening and integral exterior handle for horizontal transport.

The bag is made of a flexible material, such as low or high-density polyethylene, thermoplastic, fabric, nylon, paper or laminated paper, or the like, that may have a heat tolerance of at least 200 degrees F. for at least 60 minutes and that may be microwaveable. The preferred shape of the bag is a square or rectangle with sides in the preferable range from 5 to 36 inches, although it may also be circular, made with rounded edges, or otherwise. Depending on the material and the density of the material, the bag is transparent or opaque. It has three closed sides formed by folding, heat-sealing, sidewelds, or other means, and is open at the front. A small flap extends at the front with a means of closing the front side to keep the products secure inside, such as an adhesive strip, a pressure grip, or other similar device. The bag may have an exterior pocket extending in the preferable range of 2 to 6 inches from the front opening of the bag and sealed into the side seams, which pocket is sliced so as to form a handle of approximately 0.5 to 5 inches in width across the approximate center of the bag. The bag optionally has ventilation slits, valves, or holes, and it can also be printed with logos, names, coupons, or other advertising as desired.

The bag additionally has a handle that crosses the large exterior side of the bag. This handle can be in the shape of a large X, with the arms extending to opposite sides of the bag. Alternatively, the handle may extend as a single line across the side of the bag, from the center of one edge to the center of the opposite edge. Optionally, at least one external pocket can be added.

A product, such as a food item, is placed into the front-loading opening of the bag while still held in a horizontal position. The entire package can then be transported or stacked on top of another bagged item while keeping it in the same horizontal position. The bags are thin and do not interfere with the stacking. At the same time, the bags may serve as an insulator, forming a hot vapor thermal barrier for contents that are heated and protect the contents from contamination or a barrier to keep the contents cool.

One of the primary improvements made by this invention is the front-loading opening of the bag, which allows a product to be inserted while being held in a horizontal position, avoiding the difficulties of inserting a horizontally held product into a top-loading, vertically oriented bag. The position and strength of the handle allows a product to be carried in a horizontal position easily with one hand, avoiding the problem of displacing, crushing, breaking, spilling, or otherwise adversely affecting the product during transport, which often happens if it is carried in a vertically oriented bag.

The optional addition of ventilation slits, valves, or holes in the bag allow excess moisture to be released. The bag may be transparent, or nearly transparent, so the consumer can easily see through bag without having to open the packaging to check the contents. This function has the advantage of allowing the consumer to make certain that the contents are all that the consumer expects to purchase without having to open the sealed packaging and risk airborne or other contaminants affecting the contents.

This invention is also cost-efficient in terms of raw materials, storage of packaging, and assembly labor. There is no folding, package preparation, or other assembly required, as a product is simply inserted into the bag. If desired, a merchant can add items into the external pocket, such as coupons, condiments, utensils, napkins, advertising leaflets, and the like, obviating the need for an additional bag for such extra items. The bags lie flat and are of thin material, allowing many to be stacked, boxed, or rolled within a small area. The bag is comprised of raw materials that are available and inexpensive and that can be molded and formed cheaply and quickly. The discarded packaging may be recyclable.

The invention is also capable of being reused by the consumer. The bag is made of materials that are heat and cold tolerant and FDA approved, and so can be used to store food together or individually. The bag can additional by used for cold storage or reheating food items. This feature enhances the economic value and utility of this invention by offering space-saving storage and eliminating the need for the consumer to use additional heating of storage bags, pans, bins, containers and so forth. The materials are also of high and lasting quality such that a consumer can reuse the packaging to transport in a horizontal position anything that fits within the bag and is within the weight tolerance of the materials. As such, the packaging is friendly to the environment because it can be recycled into various uses by the consumer.

BRIEF DESCRIPTION OF THE DRAWINGS

The invention will now be described, by way of example only, with reference to the accompanying drawings, as follows.

DETAILED DESCRIPTION OF THE INVENTION

Figure 1:
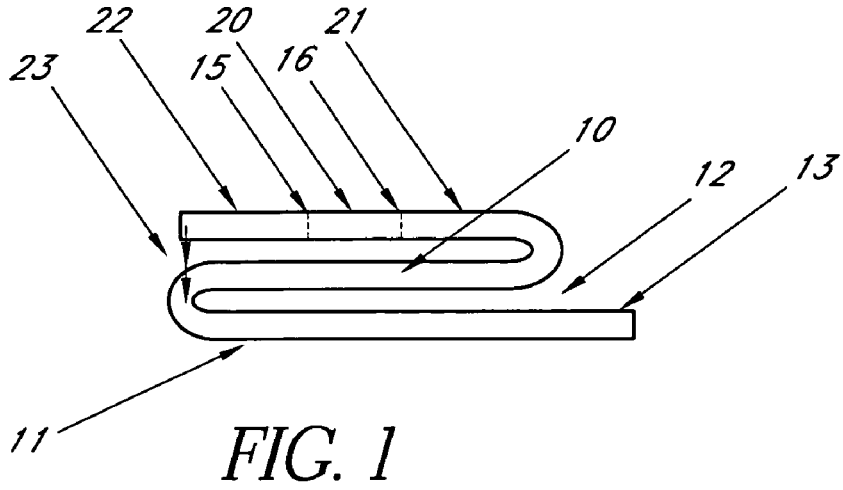
FIG. 1. Magnified side cut-away view of bag folds

FIG. 1 shows a magnified side view of one embodiment of the bag. This view shows the folds for a three-layered bag. This bag is made by means of a process that folds the material back onto itself twice. Said layers may be of any pliable material, including low or high density polypropylene, thermoplastic, fabric, nylon, paper, or laminated paper. The top of the bag is formed by the middle, or second, layer (10) and the bottom is formed by the bottom-most, or first, layer (11). Items to be stored or transported would be inserted into the opening (12) between the middle and the bottom-most layer (11). The bottom-most layer may extend beyond the fold for the middle and top-most, or third layer, allowing the bottom-most layer to have a flap (13) that can be used to close the bag.

The bag is created by making two seams, by means of a sideweld, heat seal, sewn seal, or the like, across these layers at constant intervals and cutting the layers between seams such that the resulting bag is of a preferable size of approximately 5 to 36 inches in length. The top-most layer may extend all the way to the fold of the first and second layers, as shown in this figure. The top most layer is slit twice (15) and (16), said slices being 0.5 to 5 inches apart and forming a handle (20) crossing the top side of the bag at approximately the center and one (21) or two (22) adjacent exterior pockets on either side of the handle. The second exterior pocket (22) may be further sealed by the same means as used for the side seams (23) or it may remain unsealed for use as a tear-off coupon or the like.

Optionally, the top-most layer may be folded back onto the second layer such that it extends only part of the way, but preferably at least as far as 0.25 to 2.5 inches past the center of the layers, depending on the preferred width of the handle. In this embodiment, only a single slit (15) is required in the top-most layer to create the handle and a single exterior pocket (21). With the handle, the bag has a weight tolerance of at least approximately 5 to 6 pounds.

Figure 2:
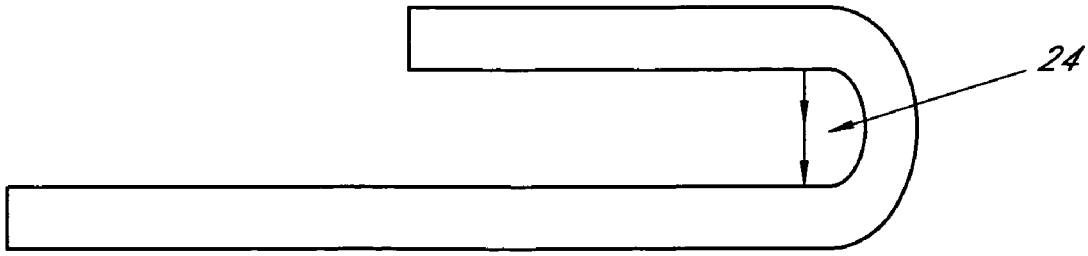
FIG. 2. Magnified side cut-away view of pocket showing sealed seam.

FIG. 2 shows the detail of a pocket 24 created by a seam of a layer.

Figure 3:
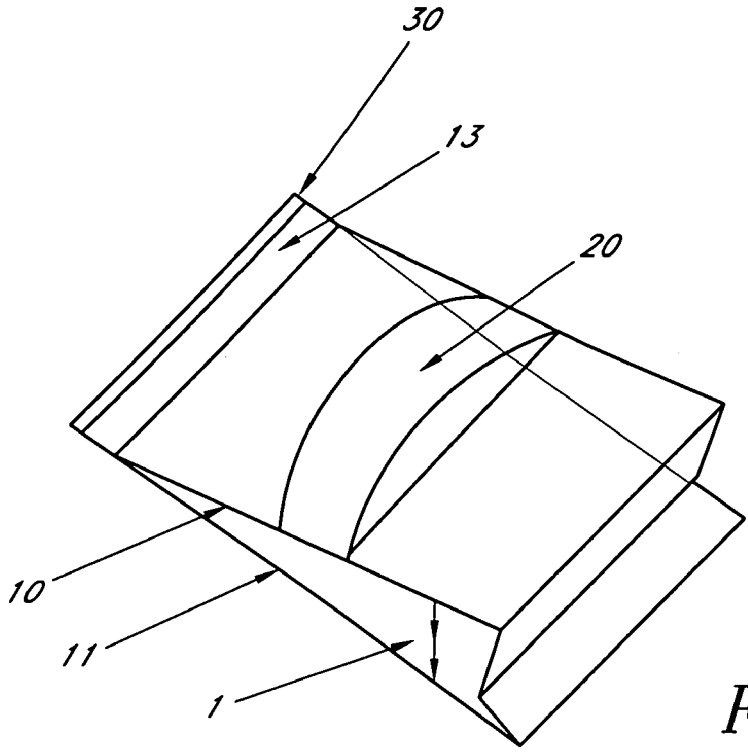
FIG. 3. Angled top view of bag showing optional sidewelds and optional inverted fold back for gusset FIG. 4. Side cutaway view of containers stacked inside the sideweld bag showing inverted fold back for gusset. Containers can be stacked in this manner while encased in the bag, or a single tall item can be stored and transported inside.

Referring to FIG. 3, this shows the bag from an angled top view. As shown in FIG. 1, a plurality of layers have been seamed together by sidewelding, heat-sealing, sewing, or the like (1) to form the bag. The opening (12) of the bag (2) is shown sealed by means of the extended flap (13) being folded back over the top-most layer and held closed by means of an adhesive, interlocking, or other closing strip (30). The handle (20) lies flat across the approximate center of the bag and is shown slightly raised in this figure for visibility purposes. The middle (10) and bottom-most (11) layers from the bag that will hold the contents.

The middle and bottom-most layer of material may be made with an inverted fold back (40) as shown in this FIG. 3, creating a gusset and allowing for the bag to open wider to hold larger contents than a single fold would allow. Such a use is demonstrated in FIG. 4.

Figure 4:
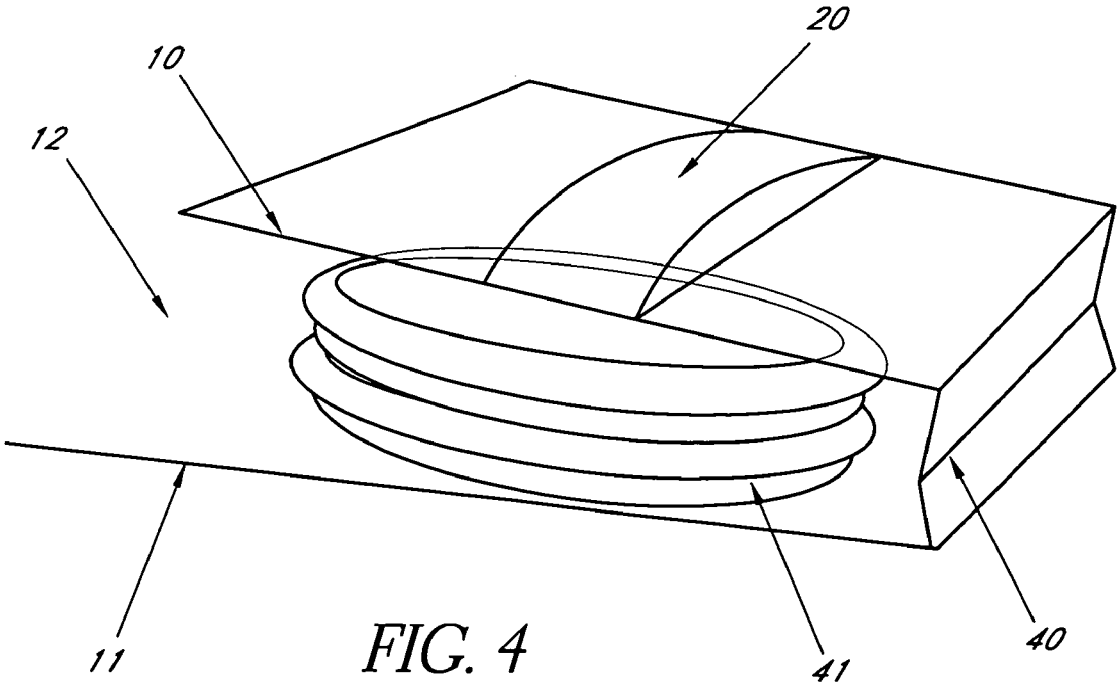

FIG. 4 is a cut-away side view of the bag wherein the optional inverted fold back (40) is used to accommodate larger contents than would be possible without the inverted fold back. In this illustration, two items have been inserted into the bag through the opening (12) between the bottom-most (11) and middle layers (10) and have been stacked in the bag (41). The extended flap (13) at the opening can be folded onto the upper layer to close the bag. The bag can be transported horizontally using the handle (20) that is attached so as to cross the top of the bag, said handle being slightly raised above the middle layer for visibility purposes in this Figure.

Figure 5:
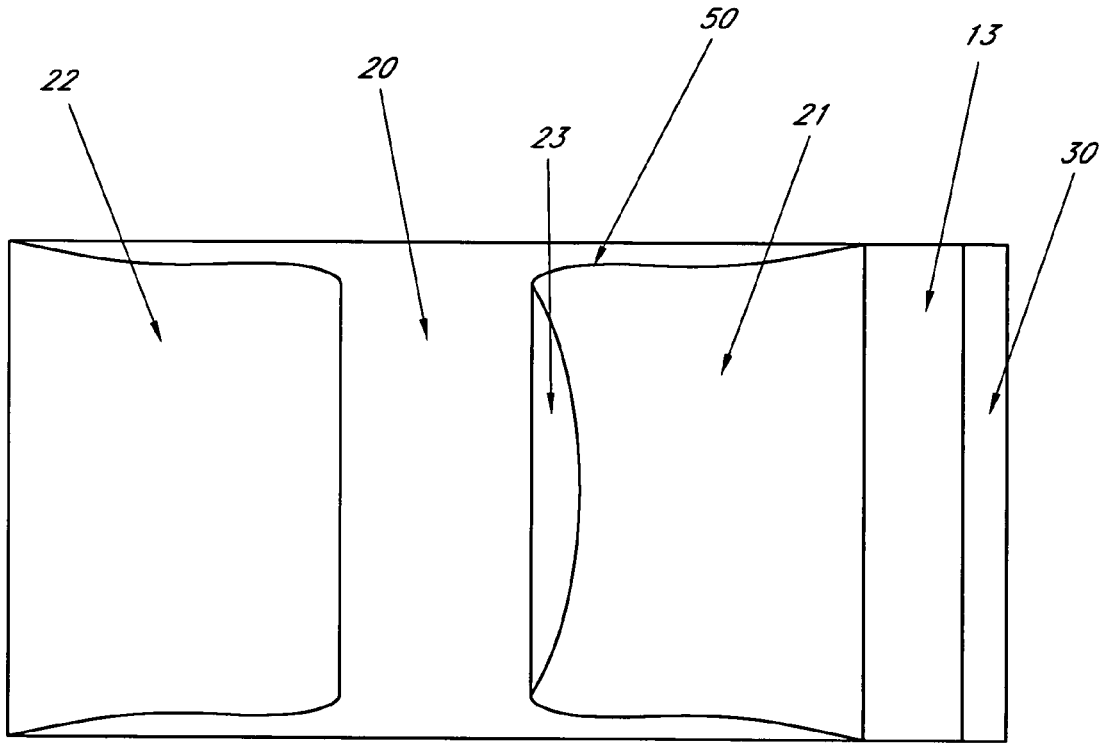
FIG. 5. Top view of bag with exterior handle and pocket

Referring to FIG. 5, the bag is viewed from the top. The side seams can be seen (50) holding all layers together. The central handle (20) crosses the bag at approximately the center, and there are optional pockets adjacent to the handle on either side (21) and (22). One of these pockets is shown open for illustrative purposes (23). The extended flap of the bottom-most layer (11) is shown open. It can be folded over the opening and attached to the upper-most layer to close and reclose the bag, such as by means of an adhesive or interlocking strip (14).

Figure 6:
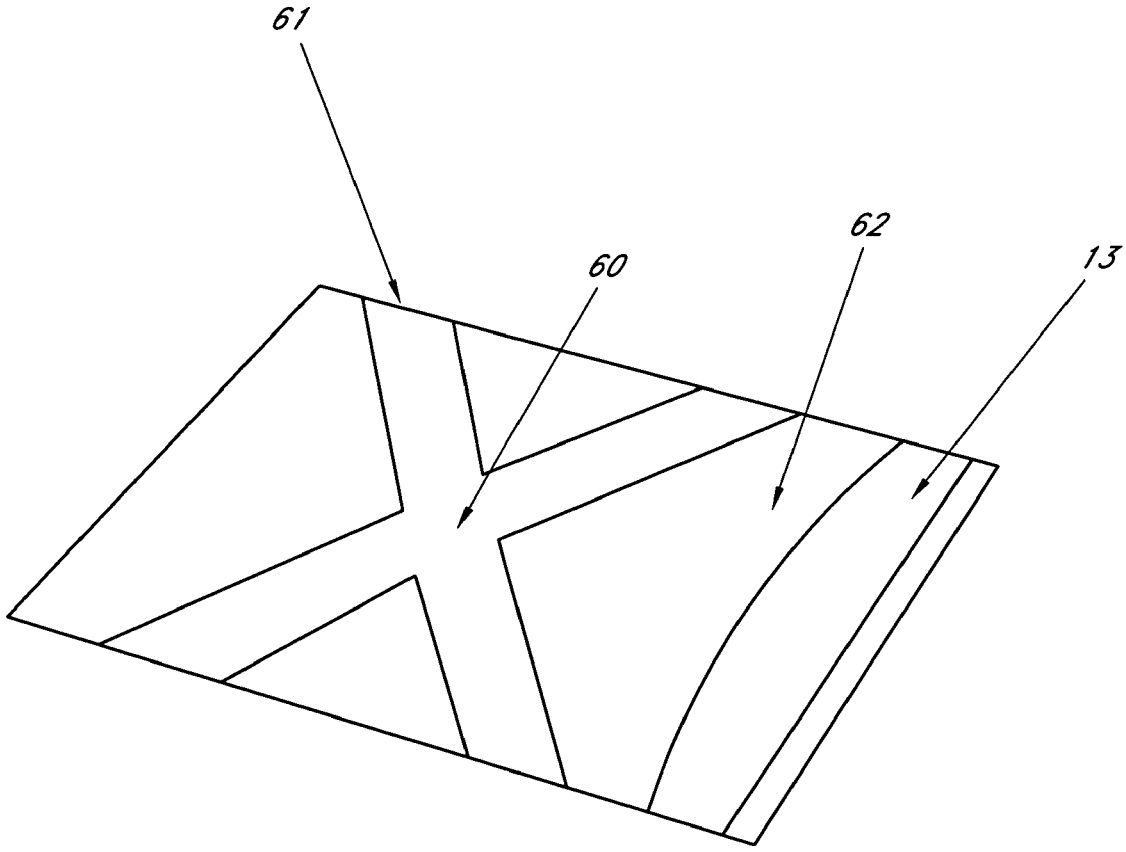
FIG. 6. Angled top view of bag with 'X' configuration handle

In FIG. 6, another embodiment of the handle is shown. In this illustration, the handle is an "X" shape with its center located at approximately the center (60) of the bag. The arms of the "X" are secured to the sides (61) of the bag as part of the side seam (1) process described in FIG. 1. The arms may be secured along the sides at various points, although there is a preferable length of separation, depending on the bag size, for purpose of stabilizing the bag movement during transport. The bag opening (12) can he closed by means of folding the extended flap of the bottom-most layer (13) back over the upper layer and securing it, such as by means of an adhesive or interlocking strip. The middle layer can be seen through the open parts of the "X" handle (10). As a further option, at least one of the triangles of the "X" handle can be left on the third layer to create an exterior pocket (62), although for purposes of stability during transport, it is preferable for only one said section to remain at the end of the bag opposite to the bag opening.

We claim:

1. A packaging system, comprising:

first, second, and third layers that are arranged generally horizontally;

wherein the first, second and third layers each have elongate side edges, the respective side edges being attached to one another so that the first, second, and third layers are disposed generally one above the other, and the second layer is disposed between the first and third layers;

wherein a main space is defined between the first and second layers, and a pocket space is defined between the second and third layers;

wherein a first aperture is formed through the third layer, the aperture providing access to the pocket space; and wherein the third layer comprises a second aperture spaced from the first aperture, wherein a handle is defined between the first and second apertures.

2. A packaging system as in claim 1, wherein the first and second layers each have rear edges, and the rear edges of the first and second layers are attached to one another.

3. A packaging system as in claim 2, wherein the first and second layers each have front edges, and the first and second layers are selectively attachable along their front edges so as to provide selective access to the main space.

4. A packaging system as in claim 3, wherein the first layer has a flap portion adjacent its front edge, and the flap has a fastener configured to selectively engage a portion of the second layer to selectively close the main space.

5. A packaging system as in claim 4, wherein the fastener comprises a reusable adhesive.

6. A packaging system as in claim 2, wherein the first and second layer rear edges are attached by a rear folding portion that extends therebetween.

7. A packaging system as in claim 6, wherein the first and second layer side edges are attached by side folding portions that extend therebetween.

8. A packaging system as in claim 2, wherein the first and second layers are formed of a substantially contiguous sheet of material, and the attached rear edges of the first and second layers comprises a fold in the contiguous sheet.

9. A packaging system as in claim 2, wherein the third layer has a rear edge, and the first, second and third layers are attached to one another along their rear edges.

10. A packaging system as in claim 9, wherein the third layer has a front edge, and the third layer front edge is attached to the second layer.

11. A package, comprising:

a contiguous sheet of material folded to overlap itself so as to form first, second and third layers, the first, second and third layers each having opposing side edges and being attached to one another along their side edges;

the first and second layers attached to one another along a first fold of the contiguous sheet, the first fold defining a rear edge of each of the first and second layers;

the second and third layers attached to one another along a second fold of the contiguous sheet, the second fold defining a front edge of each of the second and third layers;

a contents space defined between the first and second layers and between the attached side edges and the first fold;

an opening between a front edge of the first layer and a front edge of the second layer, the opening providing access to the contents space;

the first layer having a front flap, the front flap adapted to engage a portion of the contiguous sheet so as to selectively close the opening; and a secondary space defined between the second layer and the third layer, the third layer comprising a first aperture providing access to the secondary space;

wherein the third layer comprises a second aperture, and a handle is defined between the first and second apertures.

12. A package as in claim 11, wherein the contiguous sheet of material is selected from the group consisting of plastic, thermoplastic, high density polyethylene, low density polyethylene, nylon, fabric, paper, and laminated paper.

13. A package as in claim 11, wherein the contiguous sheet of material has a heat tolerance of at least 200° F. for at least 60 minutes and is microwaveable.

14. A package as in claim 11, wherein the contents space is sized and arranged to accommodate a pizza, and the first aperture is sized and arranged so that napkins can be fit at least partially into the secondary space.

15. A packaging system as in claim 1, wherein the handle is generally centrally-located relative to the second layer.

16. A packaging system as in claim 15, wherein the first and second layers are constructed of a material having a heat tolerance of at least 200° F. for at least 60 minutes.

17. A packaging system as in claim 1, wherein a front-loading opening is provided between the first and second layers to provide access to the main space.

* * * * *